US008661680B2

(12) United States Patent
Suzuki et al.

(10) Patent No.: US 8,661,680 B2
(45) Date of Patent: Mar. 4, 2014

(54) METHOD FOR MANUFACTURING ELECTROPHOTOGRAPHIC ELASTIC ROLLER

(75) Inventors: Akihiro Suzuki, Ushiku (JP); Hidetoshi Ichige, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 820 days.

(21) Appl. No.: 12/821,432

(22) Filed: Jun. 23, 2010

(65) Prior Publication Data

US 2011/0000067 A1 Jan. 6, 2011

(30) Foreign Application Priority Data

Jul. 6, 2009 (JP) ..... 2009-159486

(51) Int. Cl.
*B22D 11/12* (2006.01)

(52) U.S. Cl.
USPC ..... 29/895.32; 29/527.2; 29/895.3

(58) Field of Classification Search
USPC ..... 29/895, 895.3, 895.1, 895.32, 895.213, 29/458, 460, 527.2
See application file for complete search history.

(56) References Cited

FOREIGN PATENT DOCUMENTS

JP 2006-293015 A 10/2006
JP 2008-164987 A 7/2008

*Primary Examiner* — David Bryant
*Assistant Examiner* — Christopher Besler
(74) *Attorney, Agent, or Firm* — Fitzpatrick, Cella, Harper & Scinto

(57) ABSTRACT

A method for manufacturing a low-cost electrophotographic elastic roller having a good dimensional precision is provided. In that method, in which both end parts of a shaft core body are gripped and fixed in a vertical direction, an inclination of a central axis is corrected, a circular coating head including a circular slit is used so that the shaft core body is moved in the direction, and a elastic layer material is ejected from the slit to be coated on the shaft core body, the method includes: a maximum deflection coordinate in a longitudinal direction of the shaft core body is detected with a central axis of the shaft core body as a base point coordinate before coating; a central position of the head is moved at constant from the base point to the maximum during coating, and the position is moved to the base point after the head has reached the maximum.

5 Claims, 5 Drawing Sheets

METHOD FOR MANUFACTURING ELECTROPHOTOGRAPHIC ELASTIC ROLLER

BACKGROUND OF THE INVENTION

1. Field of the Invention

The present invention relates to a method for manufacturing an electrophotographic elastic roller for use in image forming apparatuses such as printers and copy machines, and electrophotographic process cartridges.

2. Description of the Related Art

Conventional electrophotographic recording apparatuses will be described below. Such an apparatus incorporates an image forming part in its main unit, and an image is formed by undergoing cleaning, charging, latent imaging, developing, transfer, and fixing processes. An image forming part includes a photosensitive drum which is an image carrying body, a cleaning part, a charging part, a latent image forming part, a developing part, and a transfer part. An image on the photosensitive drum, which is formed at the image forming part, is transferred to a recording material with a transfer member and conveyed, thereafter being heated and pressurized at a fixing part to be discharged as a fixed recording image.

In a printer that utilizes an electrophotographic scheme, the photosensitive drum is uniformly charged by a charging roller and forms an electrostatic latent image by a laser, etc. Next, a developing agent in a developer container is uniformly coated on a developing roller at an appropriate charge by a developing agent coating roller and a developing agent regulating member, and a transfer (development) of the developing agent is performed at a contact part between the photosensitive drum and the developing roller. Thereafter, the developing agent on the photosensitive drum is transferred to recording paper by a transfer roller and is fixed by heat and pressure (a pressure roller and a fixing roller). The developing agent which has remained on the photosensitive drum is removed by a cleaning blade, thus completing a series of processes.

In an electrophotographic apparatus, for example in the case of a developing roller, it is always in pressure contact with a photosensitive drum and a developing agent regulating member. When development is performed, the developing roller and the photosensitive drum, and the developing roller and the developing agent regulating member are in pressure contact with each other with the developing agent being interposed therebetween. The developing agent that is not transferred to the photosensitive drum is scrapped off by a developing agent coating roller and is returned to the developer container again. In the container, the developing agent is stirred and conveyed onto the developing roller again by the developing roller coating roller. Repeating these processes will result in that the developing agent undergoes high stress. Accordingly, for the purpose of mitigating stress to the developing agent, the developing roller is formed of a material having an appropriate elasticity. Further, in the cases of the developing roller and the charging roller, since they rotate constantly in contact with other members, a stable contact state must be maintained and therefore a high dimensional precision as a roller is required. If a stable contact state cannot be maintained, the feed amount of the developing agent may vary and also the pressure distribution of the photosensitive drum may vary thereby affecting the resulting image.

Moreover, in recent years, needs for the conversion to color images and higher quality images of electrophotography have grown and accordingly higher precisions for outer dimensions and thickness (suppression of deflection) of the electrophotographic elastic roller are stringently required. For example, in a contact development scheme, since the developing roller is in contact with the surface of the photosensitive drum as described above, insufficient precisions in the outer dimensions and thickness will cause variations in the nip width and nip force between the photosensitive drum and the roller leading to image defects such as density variations.

Developing rollers for use in such a contact developing scheme are configured to have an elastic roller provided with an elastic layer around a shaft core body. Moreover, as desired, an elastic roller is configured to have a surface layer obtained by coating various resin solution to the outer periphery of the elastic layer to provide surface quality.

Conventionally, it is often the case that molding methods using dies are used to manufacture elastic rollers. Moreover, as the method of forming an elastic layer material on the outer periphery of a shaft core body without using dies; various processes, for example, a spray coating process, an immersion coating process, a roll coating process, a blade coating process, a method of coating in a circular coating tank, a coating process using a circular coating head, and others are being studied.

In these conventional coating methods, to achieve an elastic layer having a thickness of about several millimeters, a high-viscosity elastic layer material is diluted with a solvent, and the elastic layer material is coated with the viscosity thereof being lowered to a level needed for coating work. Thereafter, the solvent used for the dilution of the elastic layer material is removed by, for example, vaporizing thereby forming an elastic layer. However, it is inevitable to repeat the process of overcoating the formed elastic layer with an elastic layer material and the process of removing the solvent, resulting in a very low productivity. Moreover, in the elastic rollers manufactured in this way, since many processes are repeated causing the tolerances in the dimensional precision and the deflection (thickness precision) to build up, it is difficult to control the dimensional precision and the deflection (thickness precision) as an elastic roller.

One method for directly coating a high-viscosity elastic layer material onto a shaft core body is a coating method utilizing a circular coating head (see, for example, Japanese Patent Application Laid-Open No. 2006-293015). In this method, the shaft core body and a ring-shaped coating head are disposed such that a uniform gap is formed between the inner peripheral surface of the coating head and the outer peripheral surface of the shaft core body. This method includes a step of causing non-hardened elastic layer material to be ejected from the coating head while moving the shaft core body and the coating head to form a non-hardened elastic layer around the shaft core body, and a step of hardening the non-hardened elastic layer to form an elastic layer. Moreover, the non-hardened elastic layer material is a non-Newtonian liquid material having a yield stress of not less than 50 Pa and not more than 600 Pa, and a thixotropy index of not less than 2.0 and not more than 6.5. This method allows an elastic layer material to be directly coated onto the outer periphery of the shaft core body with an apparatus more readily to form a favorable and uniform elastic layer having a layer thickness of about several millimeters.

Further, another method, first, grips and fixes a shaft core body at upper and lower end parts thereof, and corrects the inclination between the both end parts of the shaft core body caused by the grip fix of the shaft core body. Thereafter, using a coating head having a circular slit that opens inwardly, the coating head is relatively moved with respect to the shaft core body and a non-hardened elastic layer material having a viscosity of 10 to 5000 Pa·s is ejected from the circular slit to be coated onto the outer periphery of the shaft core body. The method includes thereafter hardening the material to manufacture an elastic roller (see, for example, Japanese Patent Application Laid-Open No 2008-164987). This method allows for the manufacturing of an elastic roller having a certain level of dimensional precision, particularly a good thickness precision of the elastic layer compared with a high dimensional precision required for the enhancement of image quality, etc.

According to those methods described above, since a large number of high precision dies are not required as in the case of a die molding, the cost of the production facilities can be significantly suppressed. Moreover, since the number of process steps is small, downsizing of the production facilities can be realized. This allows the forming of a low-cost and high-precision elastic roller, but further improvements are desired to address the needs for the conversion to color images and higher quality images of electrophotography.

SUMMARY OF THE INVENTION

It is an object of the present invention to provide a method for manufacturing a stable and low-cost electrophotographic elastic roller having a good dimensional precision, in particular, a small deflection (a good thickness precision of the elastic layer) and good repetitive reproducibility.

The method for manufacturing an electrophotographic elastic roller relating to the present invention is a method for manufacturing an electrophotographic elastic roller, in which both end parts of a shaft core body are gripped and fixed in a vertical direction, an inclination of a central axis connecting centers of both end faces of the shaft core body with respect to the vertical direction due to the grip and fix of the shaft core body is corrected, a circular coating head including a circular slit that opens inwardly is used so that the shaft core body is relatively moved in the vertical direction with respect to the circular coating head, and a non-hardened elastic layer material is ejected from the circular slit to be coated and hardened on an outer periphery of the shaft core body, the method for manufacturing an electrophotographic elastic roller including: a shaft core body deflection coordinate detection step in which a maximum deflection coordinate in a longitudinal direction of the shaft core body which is gripped and fixed is detected with a central axis of the shaft core body taken as a base point coordinate before the ejection to coat the non-hardened elastic layer material; and a circular coating head position correction step in which a central position of the circular coating head is moved at a constant proportion from the base point coordinate in the direction to the maximum deflection coordinate during the ejection to coat the non-hardened elastic layer material, and the central position of the circular coating head is moved at a constant proportion in the direction to the base point coordinate after the circular coating head has reached a longitudinal position of the shaft core body at which the maximum deflection coordinate has been detected.

Moreover, in the method, the shaft core body deflection coordinate detection step is performed at middle portion in the longitudinal direction of the shaft core body.

Moreover, in the method, the circular coating head position correction step is performed by an X-Y stage moving the circular coating head, the circular coating head being fixed to the X-Y stage.

Moreover, in the method, the shaft core body deflection coordinate detection step and the circular coating head position correction step are repeated for each individual of the shaft core body.

Moreover, in the method, the viscosity of the non-hardened elastic layer material is 10 Pa·s or more and 5000 Pa·s or less.

Moreover, in the method, a maximum moving amount of the circular coating head is from the base point coordinate to 1% or more and 80% or less of the maximum deflection coordinate.

According to the present invention, it is possible to provide a method for manufacturing a stable and low-cost electrophotographic elastic roller having a good dimensional precision, in particular, a small deflection (a good thickness precision of the elastic layer) and good repetitive reproducibility.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereafter, a method for manufacturing an electrophotographic elastic roller (hereafter, sometimes simply referred to as an elastic roller) according to the present invention will be described in detail.

The method for manufacturing an electrophotographic elastic roller relating to the present invention is a method for manufacturing an electrophotographic elastic roller, in which both end parts of a shaft core body are gripped and fixed in a vertical direction, an inclination of a central axis connecting centers of both end faces of the shaft core body with respect to the vertical direction due to the grip and fix of the shaft core body is corrected, a circular coating head including a circular slit that opens inwardly is used so that the shaft core body is relatively moved in the vertical direction with respect to the circular coating head, and a non-hardened elastic layer material is ejected from the circular slit to be coated and hardened on an outer periphery of the shaft core body, the method for manufacturing an electrophotographic elastic roller including: a shaft core body deflection coordinate detection step in which a maximum deflection coordinate in a longitudinal direction of the shaft core body which is gripped and fixed is detected with a central axis of the shaft core body taken as a base point coordinate before the ejection coating of the elastic layer material; and a circular coating head position correction step in which a central position of the circular coating head is moved at a constant proportion from the base point coordinate in the direction to the maximum deflection coordinate during the ejection coating of the elastic layer material, and the central position of the circular coating head is moved at a constant proportion in the direction to the base point coordinate after the circular coating head has reached a longitudinal position of the shaft core body at which the maximum deflection coordinate has been detected.

(Ring Coating Machine)

Figure 1:
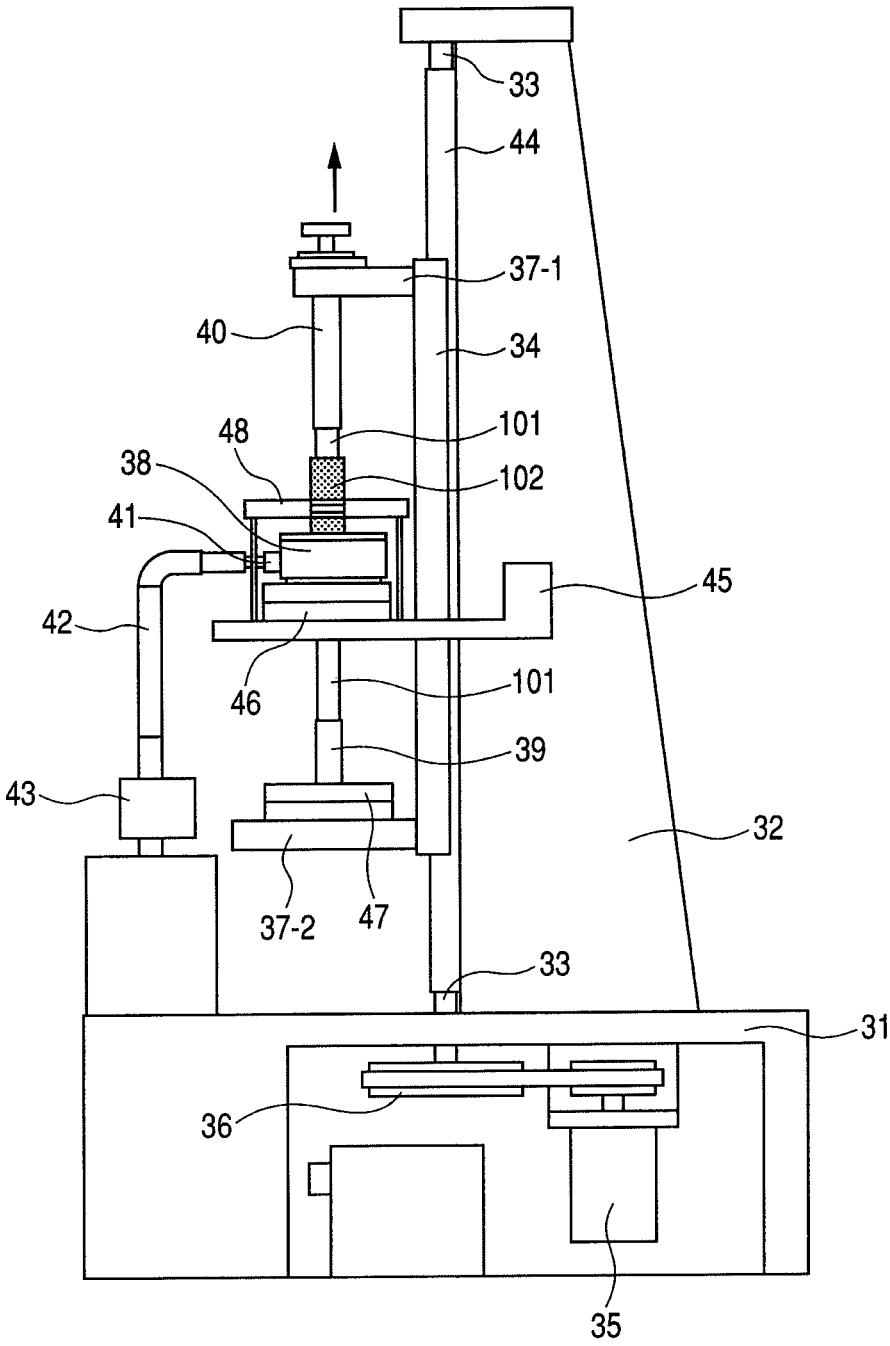
FIG. 1 is a schematic cross-sectional diagram to illustrate a ring coating machine relating to the present invention.

FIG. 1 is a schematic diagram to illustrate an example of a ring coating machine including a circular coating head which can be suitably used for the method for manufacturing an electrophotographic elastic roller of the present invention.

The ring coating machine includes a base stand 31, a column 32 which is substantially vertically attached onto the base stand 31, and a precision ball screw 33 which is substantially vertically attached to the base stand 31 and an upper part of the column 32. Moreover, two linear guides 44 are attached to the column 32 in parallel with the precision ball screw 33. An LM guide 34 connects the linear guide 44 and the precision ball screw 33 and is configured to be able to move up and down by a rotational movement transferred from a servomotor 35 via a pulley 36. A circular coating head fixing table 45 is attached to the column 32. A circular coating head position correction X-Y stage 46 is attached to the circular coating head fixing table 45, and a circular coating head 38 is attached onto the circular coating head position correction X-Y stage 46. Moreover, two optical length-measuring instruments 48 each that detect the positions of the shaft core body 101 and the circular coating head 38 are attached to the circular coating head fixing table 45 in each of X and Y directions in such a way that the shaft core body 101 is interposed therebetween. It is noted that X and Y (coordinates) are orthogonal coordinates in a plane (a horizontal plane in this case).

Brackets 37-1, 37-2 are attached to the LM guide 34. A shaft core body position correction X-Y stage 47 is attached to an upper part of the bracket 37-2. Moreover, lower shaft core body-holding shaft 39 which holds and fixes the shaft core body 101 is attached substantially vertically onto the shaft core body position correction X-Y stage 47. Furthermore, the upper shaft core body-holding shaft 40 which holds the upper end part of the shaft core body 101 is attached to a lower part of the bracket 37-1. The upper shaft core body-holding shaft 40 is disposed such that a central axis of the upper shaft core body-holding shaft 40 is substantially concentric with that of the lower shaft core body-holding shaft 39, and holds the shaft core body 101.

The circular coating head 38 is provided with a circular slit that opens inwardly and can eject an elastic layer material from the circular slit. The circular coating head 38 is supported such that the central axis of the circular slit, which opens at the inward side of the circular coating head 38, is parallel with each of the moving directions of the lower shaft core body-holding shaft 39 and the upper shaft core body-holding shaft 40. Moreover, the central axis of the circular slit that opens at the inward side of the circular coating head 38 is adjusted to be substantially concentric with that of the lower shaft core body-holding shaft 39 and the upper shaft core body-holding shaft 40 during up and down movement of the lower shaft core body-holding shaft 39 and the upper shaft core body-holding shaft 40.

A feed port 41 of the elastic layer material is connected to a material feed valve 43 via a piping 42. A mixer, a material feed pump, a material dispensing apparatus, a material tank, and the like are provided on the backward side of the material feed valve 43, and the material feed valve 43 is configured to be able to eject fixed amount (a constant amount per unit time) of elastic layer material. A fixed amount of the elastic layer material is measured by the material dispensing apparatus from the material tank, and is mixed at the mixer. Thereafter, the mixed elastic layer material is forwarded to the feed port 41 from the material feed valve 43 via the piping 42 by the material feed pump.

The elastic layer material thus forwarded from the feed port 41 passes through a flow path in the circular coating head 38 and is ejected from the circular slit that opens at the inward side of the circular coating head 38. The circular slit opens over the entire inner periphery of the circular coating head 38. The ejected elastic layer material is then coated on the outer peripheral surface of the shaft core body 101. In order to coat the elastic layer material at a uniform thickness, the shaft core body 101 being held is moved upwardly in the axial direction (the central axis direction of the shaft core body 101) while the ejection amount from the circular slit of the circular coating head 38 and the feed amount from the material feed pump are kept constant. As a result of this, the shaft core body 101 is relatively moved in the axial direction with respect to the circular coating head 38 so that an elastic layer 102 having a cylindrical shape (roll shape) and made up of the elastic layer material is formed on the outer periphery of the shaft core body 101.

(Preliminary Preparation of Manufacturing of Elastic Roller)

As an example of the method relating to the present invention, a method for manufacturing an electrophotographic elastic roller relating to the present invention will be shown below by using a ring coating machine provided with the circular coating head 38 shown in FIG. 1.

Upon manufacturing an electrophotographic elastic roller, first, the position of the circular coating head 38 is adjusted (corrected) such that the center of the upper shaft core body-holding shaft 40 or the lower shaft core body-holding shaft 39, which serves as a positional reference, coincides with the center of the circular slit that opens at the inward side of the circular coating head 38. Either may be chosen as the reference, but usually, the upper shaft core body-holding shaft 40 is chosen as the reference. Hereafter, a correction method when the upper shaft core body-holding shaft 40 is chosen as the reference will be described.

First, the LM guide 34 shown in FIG. 1 is moved in vertical direction to adjust the tip end of the upper shaft core body-holding shaft 40 to fall into the measuring range of the optical length-measuring instrument 48, and the position coordinates (X and Y coordinates in horizontal plane) of the center of the upper shaft core body-holding shaft 40 are read out.

Next, the position of the circular coating head 38 is corrected. Examples of the method of correcting the position of the circular coating head 38 include, for example, a method in which the position of the circular coating head 38 is determined in a contact manner to be adjusted, and a method in which a pin which serves as a reference is erected at the circular coating head 38 and the position coordinate of the circular coating head 38 is determined in a non-contact manner by the optical length-measuring instrument 48.

Figure 2:
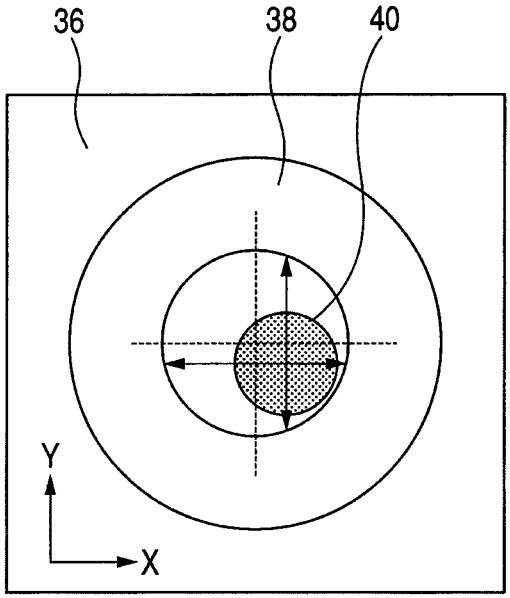
FIG. 2 is a schematic diagram to illustrate an example of the method of correcting the position of a circular coating head with reference to the position coordinate of an upper shaft core body-holding shaft relating to the present invention.

As an example, a method of correcting the position of the circular coating head 38 when the position coordinate of the upper shaft core body-holding shaft 40 is used as the reference will be described by using FIG. 2. First, the LM guide 34 (not shown in FIG. 2) is moved in vertical, direction such that the upper shaft core body-holding shaft 40 is brought into contact with the circular slit that opens at the inward side of the circular coating head 38. Thereafter, the circular coating head 38 is moved in horizontal directions (X and Y directions) respectively by the circular coating head position correction X-Y stage 46 as shown by the arrows of FIG. 2. The contact between the circular coating head 38 and the upper shaft core body-holding shaft 40 is detected and the position of the circular coating head 38 is corrected such that the center of the upper shaft core body-holding shaft 40 is superposed with the center of the circular coating head 38 from the moving amount in the X and Y directions of the circular coating head 38.

To be specific, the circular coating head 38 is moved in horizontal directions (X and Y directions) respectively as shown by the arrows of FIG. 2 by, for example, the circular coating head position correction X-Y stage 46 which is driven by a stepping motor. As the circular coating head 38, one including a circuit which is brought into conduction when it comes into contact with the upper shaft core body-holding shaft 40 is used. The moving amounts, with which the stepping motor is instructed when the circular coating head 38 and the upper shaft core body-holding shaft 40 come into contact (conduction) in the movement in the X and Y directions, are recorded in the X and Y directions. The central position of the circular coating head 38 with reference to the upper shaft core body-holding shaft 40 is calculated based on the moving amount in the X and Y directions of the circular coating head 38, and the circular coating head 38 is moved to the central position thereby being corrected.

As a result of this operation, the shaft core body 101 is gripped at the center of the upper shaft core body-holding shaft 40 so that the central coordinate of the circular coating head 38 and the coordinate of the central axis (axis connecting the centers of both end faces of the shaft core body) of the shaft core body 101 become identical thus enabling a coating with a uniform thickness.

(Manufacture of Elastic Roller)

Figure 3A:
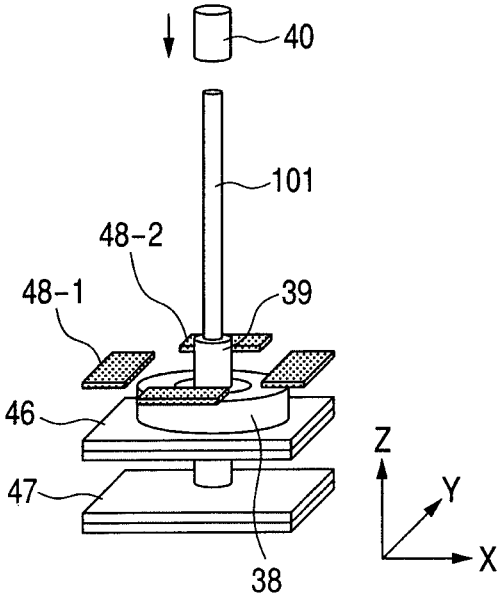
FIGS. 3A, 3B, 3C and 3D are schematic diagrams to illustrate the method for manufacturing an elastic roller relating to the present invention.

An example of the method for manufacturing an electrophotographic elastic roller relating to the present invention will be described by using FIGS. 3A to 3D and FIGS. 4A to 4B. In a ring coating machine in which the position of the circular coating head 38 is adjusted in advance as described above, grip fix of the both end parts of the shaft core body 101 in vertical direction are performed by the upper shaft core body-holding shaft 40 and the lower shaft core body-holding shaft 39. In the present invention, the grip fix of the both end parts of the shaft core body 101 in a vertical direction means that the both end parts of the shaft core body 101 are gripped and fixed at upper and lower positions such that the central axis of the shaft core body 101 is parallel with the vertical direction as shown in FIG. 3A.

Figure 3B:
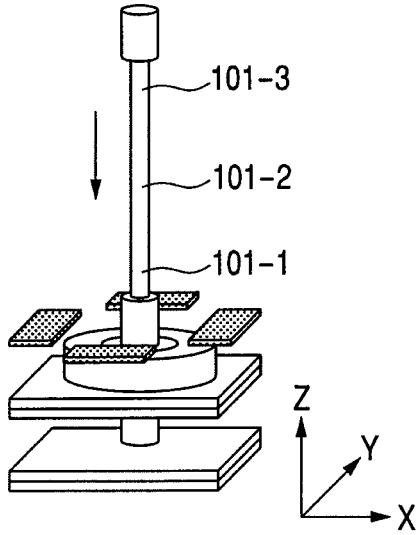

Next, the LM guide 34 (not shown in FIGS. 3A to 3D) is moved downward with the both end parts of the shaft core body 101 being in grip fix. At this moment, the position coordinates (X and Y coordinates in a horizontal plane) at three longitudinal positions 101-1, 101-2 and 101-3 of the shaft core body 101 are detected by an X-direction optical length-measuring instrument 48-1 and a Y-direction optical length-measuring instrument. 48-2 as shown in FIG. 3B. This detection is performed with the coordinate of the central axis of the shaft core body 101 being the base point coordinate.

Here, the coordinates of the longitudinal positions 101-1 and 101-3 of the shaft core body 101 are coordinates for the purpose of correcting the inclination between both end parts of the shaft core body 101 due to grip fix of the shaft core body 101. As the longitudinal positions 101-1 and 101-3 of the shaft core body 101, though dependent on the length of the shaft core body 101, usually two points preferably within 80 mm, and more preferably within 50 mm, from both end parts of the shaft core body 101 are selected, respectively. A closer position to an end part of the shaft core body is more preferable in the aspect of precision.

In the present invention, a shaft core body deflection coordinate detection step for detecting a maximum deflection coordinate (X and Y coordinates in a horizontal plane) of the shaft core body 101 in the longitudinal direction of the shaft core body 101 is performed. Usually, the central axis of the shaft core body 101 is slightly deflected in the X and Y directions with respect to the straight line connecting the centers of both end faces of the shaft core body 101. The maximum deflection coordinate is defined to be the coordinate (X and Y coordinates) of the shaft core body 101 in the longitudinal direction of the shaft core body 101 at which the deflection is maximum.

The longitudinal position 101-2 of the shaft core body 101 is a position for detecting the maximum deflection coordinate of the shaft core body 101. The longitudinal position 101-2 of the shaft core body 101 is preferably in a middle portion in the longitudinal direction of the shaft core body 101. This is because it is often the case that a maximum deflection in the shaft core body 101 takes place in a middle portion of the shaft core body 101 from the aspect of the manufacturing of the shaft core body 101 described below.

Figure 3C:
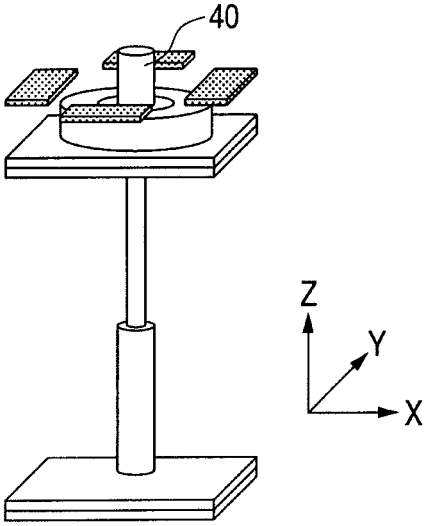

Thereafter, until the position coordinates of the lower end of the upper shaft core body-holding shaft 40 are detected by the X-direction optical length-measuring instrument 48-1 and the Y-direction optical length-measuring instrument 48-2, the LM guide 34 is moved downward (FIG. 3C).

Figure 3D:
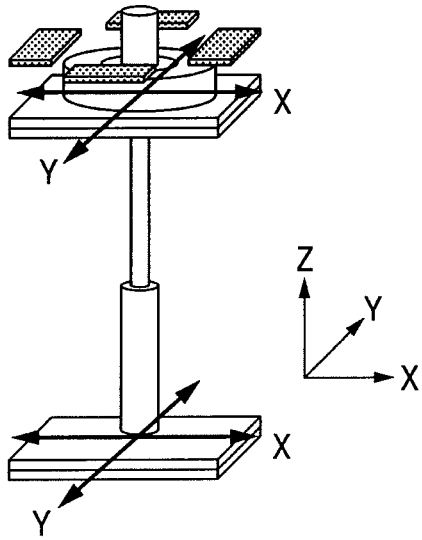

Next, so as to cancel a difference between the position coordinate of the longitudinal position 101-1 of the shaft core body 101 and the position coordinate of the longitudinal position 101-3 of the shaft core body 101, the lower shaft core body-holding shaft 39 is moved for correction by the shaft core body position correction X-Y stage 47 by the amount equal to the difference (FIG. 3D). This enables the correction of the inclination of the central axis of the shaft core body 101.

Moreover, as needed, a difference between the position coordinate of the position 101-3 of the shaft core body 101 and the central coordinate of the upper shaft core body-holding shaft 40 which has been measured in advance is added or multiplied a coefficient so that the position of the circular coating head 38 is corrected by the circular coating head position correction X-Y stage 46 (FIG. 3D). This coefficient is originated from the molecular weight of the elastic layer material, the kinds and loadings of additives contained in the elastic layer material, and the configuration within the circular coating head 38, and may be determined appropriately. This enables the correction of a deviation of the elastic layer when the elastic layer material is coated.

Here, the X and Y coordinates of the central axis of the shaft core body 101 after the correction of the inclination of the both end parts of the shaft core body 101 due to grip fix of the shaft core body 101 and the correction of the position of the circular coating head 38 are performed, are supposed to be the base point coordinate upon a start of coating.

It is noted that by the inclination correction of the central axis of the shaft core body 101 and the position correction of the circular coating head 38, the coordinate of the position 101-2 of the shaft core body 101 which has been detected before the correction are calculated according to the correction amounts. The calculated coordinate will become the maximum deflection coordinate of the position 101-2 of the shaft core body 101 during coating.

Figure 4A:
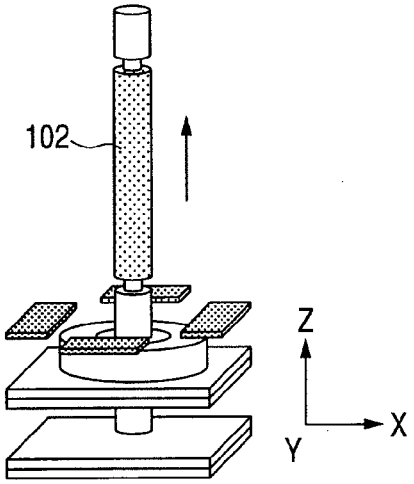
FIGS. 4A and 4B are schematic diagrams to illustrate the method for manufacturing an elastic roller relating to the present invention.
Figure 4B:
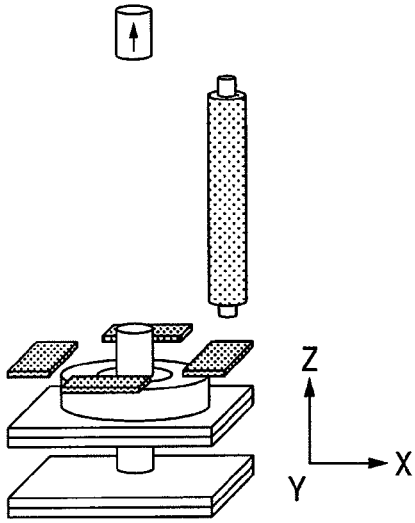

Thereafter, by moving the shaft core body 101, which is being held, upwardly in vertical direction while the elastic layer material is being ejected from the circular coating head 38, a layer 102 having a cylindrical shape (roll shape) and made up of an elastic layer material is formed on the outer periphery of the shaft core body 101 (FIG. 4A). After the completion of coating, the upper shaft core body-holding shaft 40 is moved upwardly, and the shaft core body 101 is detached from the ring coating machine so that an elastic roller (non-hardened) is manufactured (FIG. 4B).

The present invention includes a circular coating head position correction step in which during an ejection coating of the elastic layer material, the central position of the circular coating head 38 is moved at a constant proportion from the base point coordinate in the direction to the maximum deflection coordinate, and after the circular coating head 38 has reached the longitudinal position of the shaft core body 101 where the maximum deflection coordinate is detected, the central position of the circular coating head 38 is moved at a constant proportion in the direction to the base point coordinate.

Figure 5A:
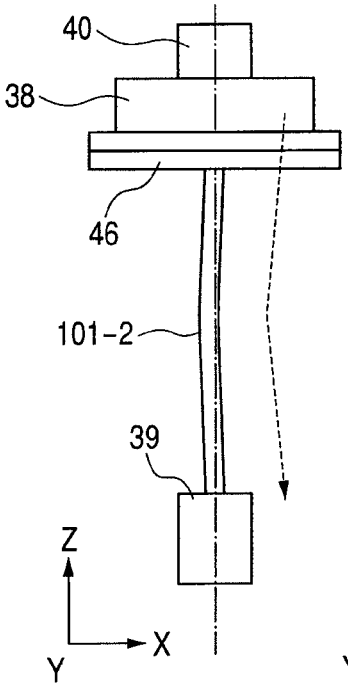
FIGS. 5A, 5B and 5C are schematic diagrams to illustrate the method for manufacturing an elastic roller relating to the present invention.
Figure 5B:
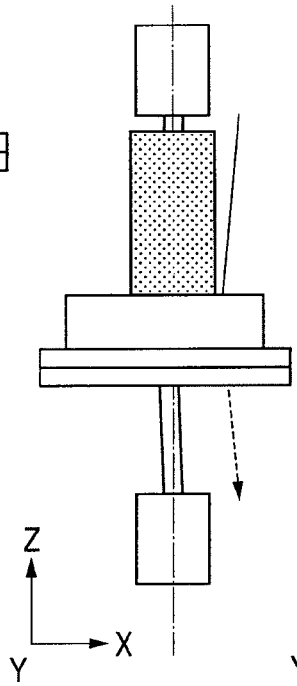
Figure 5C:
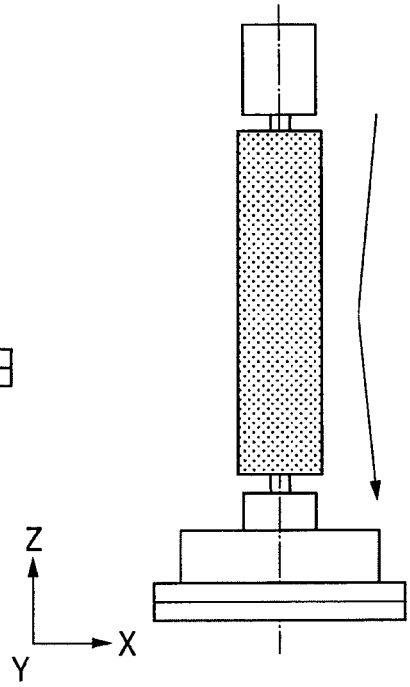

For example, FIGS. 5A to 5C show an example in which the maximum deflection coordinate of the shall core body 101 is detected with the longitudinal position 101-2 of the shaft core body 101 taken as the middle portion in the longitudinal direction of the shaft core body 101, and the shaft core body 101 is deflected only in the X-direction (FIG. 5A). While the shaft core body 101 is moved in vertical direction, the central position of the circular coating head 38 is moved at a constant proportion in the X-axis direction which is the same direction as that from the base point coordinate in the direction to the maximum deflection coordinate by the circular coating head position correction X-Y stage 46 during coating (FIG. 5B). After the middle portion in the longitudinal direction of the shaft core body 101 has reached the position of the circular slit of the circular coating head 38, the central position of the circular coating head 38 is moved in the direction to the base point coordinate, and the central position of the circular coating head 38 is returned to the base point coordinate, thereby finishing coating (FIG. 5C).

Figure 6:
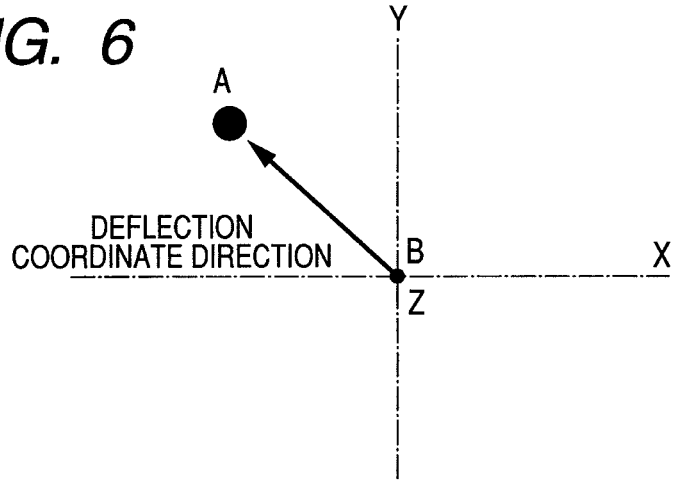
FIG. 6 is a schematic diagram to illustrate the direction of a maximum deflection coordinate and the direction of a base point coordinate relating to the present invention.

Here, a description will be made on the terms, the direction to the maximum deflection coordinate and the direction to the base coordinate, by using FIG. 6. The direction to the maximum deflection coordinate refers to the direction to connect the base point coordinate to the maximum deflection coordinate. As shown in FIG. 6, the direction (direction shown by the arrow) of a line connecting the base point coordinate B to the maximum deflection coordinate A at the longitudinal position 101-2 of the shaft core body 101 is the direction to the maximum deflection coordinate. On the other hand, the direction to the base point coordinate indicates the opposite direction of the direction to the maximum deflection coordinate.

In the coating described above, due to a clearance existent between the circular slit of the circular coating head 38 and the shaft core body 101, difference in the material pressure of the ejected elastic layer material takes place between the shaft core body 101 and the circular slit. When the clearance is narrow, the material pressure increases thereby releasing the pressure, and therefore the ejected material is more likely to enter into a part of a wider clearance, that is, a part in which the material pressure is low. As a result of that, the elastic layer thickness becomes smaller at a position where the clearance is narrow, and the elastic layer thickness becomes larger at a position where the clearance is wide, causing an increase in the deflection as an electrophotographic elastic roller. Therefore, in the present invention, by performing a positional correction (movement) of the circular coating head 38 at a constant proportion in the direction to the maximum deflection coordinate and in the direction to the base point coordinate of the shaft core body 101, the width of clearance can be kept uniform to a certain level to eject the elastic layer material in that state. This allows the reduction of the deflection of the electrophotographic elastic roller.

In the circular coating head position correction step, the moving amount (maximum moving amount) of the circular coating head 38 in the X-Y plane for the time while the circular slit portion of the circular coating head 38 moves from the base point coordinate position of the longitudinal direction of the shaft core body 101 to the maximum deflection coordinate position may be appropriately determined according to the molecular weight of the elastic layer material, the kinds and loadings of additives contained in the elastic layer material, and the configurations within the circular coating head 38, etc. The above-described maximum moving amount is preferably from the base point coordinate to 1% or more and 80% or less of the maximum deflection coordinate. If it is more than 1%, the difference in the material pressure of the ejected elastic layer material between the shaft core body 101 and the circular slit can be mitigated. Moreover, if it is not more than 80%, the thickness of the elastic layer can be avoided from following the deflection of the shaft core body 101. A more preferable range is 5% or more and 50% or less.

It is noted that as described above, the correction of the position of the circular coating head 38 is preferably performed by the circular coating head position correction X-Y stage 46 to which the circular coating head 38 is fixed, since there is no need of further addition of equipment.

In the present invention, it is preferable to repeat the shaft core body deflection coordinate detection step and the circular coating head position correction step for each individual of the shaft core body 101. As described before, in the electrophotographic elastic roller, a high level of precision is required for the outer diameter dimension and the deflection. Accordingly, taking into consideration the deflection in each individual of the shaft core body 101 allows the manufacturing of electrophotographic elastic rollers having a high deflection precision with a good repeatability. That is, when grip fix is performed at both end parts, the deflection coordinate (X and Y coordinates) of each one of the shaft core body 101 will be random. Therefore, by repeating the shaft core body deflection coordinate detection step and the circular coating head position correction step for each individual of the shaft core body 101, it is possible to achieve a high deflection precision as an electrophotographic elastic roller. Moreover, a method for manufacturing an electrophotographic elastic roller with a high stability will be achieved without depending on production lots of the shaft core body 101.

Thus, in the method according to the present invention, the deflection of the shaft core body 101 itself is detected by the shaft core body deflection coordinate detection step and the circular coating head position correction step and, according to the detection result, the position of the circular coating head 38 is corrected during coating. This enables the improvement of the thickness precision of the elastic layer thereby allowing an electrophotographic elastic roller with a small deflection to be manufactured without depending on the deflection of the shaft core body 101 itself.

The shaft core body 101 used in the present invention functions as an electrode and a support member. The shaft core body 101 is made of a material such as, for example, metals such as aluminum, copper alloys, and stainless steel, etc., iron plated with a alloy, chromium, nickel, etc., or synthetic resins. The shape thereof is preferably of a column or of a cylinder with a hollow center. The outer diameter of the shaft core body 101 may be appropriately determined, but usually a range of 4 to 20 mm is chosen. Usually, a round bar steel is used for the shaft core body 101 from the viewpoint of strength and workability. The round bar steel is manufactured by drawbench, whereby a wire rod which is a coiled material is drawn by a draw die, thereafter being cut and ground. Since shaft core body 101 is used for an electrophotographic elastic roller of which high precision is required, to achieve such precision, the shaft core body 101 itself is required to have a high precision. Then, a correction mechanism is provided with the drawbench so that the coil has high straightness thereby achieving high precision, but which will inevitably increase the cost. It is noted that due to the intrinsic history of coil possessed by the material, the position at which the deflection becomes maximum in the longitudinal direction of the shaft core body 101 is often a middle portion in the longitudinal direction of the shaft core body 101 when the shaft core body 101 is gripped and fixed at both end parts. Therefore, as described above, it is preferable that in the shaft core body deflection coordinate detection step, the detection of the maximum deflection coordinate of the shaft core body 101 is performed at a middle portion in the longitudinal direction of the shaft core body 101.

The shaft core body 101 used in the present invention preferably has a deflection of not more than 100 μm at a middle portion in the longitudinal direction (Z coordinate) of the shaft core body 101 in the state of being gripped and fixed at both end parts as described above. If the deflection is not more than 100 μm, an electrophotographic roller with a small deflection can be manufactured. Moreover, if the deflection is not more than 100 μm, there is no need of providing a correction mechanism with the drawbench, which is advantageous in cost. It is noted that the lower limit of the deflection at a middle portion in the longitudinal direction (Z coordinate) of the shaft core body 101 is preferably a minimum deflection obtained by a presently available manufacturing process from the aspect of mitigating the effect of the deflection of the shaft core body itself on the deflection as the electrophotographic elastic roller.

The elastic layer material in the present invention is preferably a polymer which has fluidity at room temperature and which is hardened while being heated. Specific examples include liquid diene rubbers (butadiene rubber, isoprene rubber, nitrile rubber, chloroprene rubber, ethylene-propylene rubber, etc.), liquid silicone rubbers, liquid urethane rubbers, and the like. These rubbers may be used singly or in combination of two or more kinds. Among them, liquid silicone rubber and a liquid urethane rubber are preferably used as the elastic layer material since it is important that the elastic layer has a sufficient deformation recovery ability. Using addition reaction cross-linked type liquid silicone rubber is more preferable from the aspect that it has an excellent productivity such as it has particularly a good workability and a high stability of dimensional precision, and produces no reaction by-product during hardening reaction.

An example of the above-described liquid silicone rubber includes a composition which contains, for example, organopolysiloxane (liquid A) and organohydrogenpolysiloxane (liquid B), and further contains a catalyst and other additives as needed. The above-described organopolysiloxane is a base polymer for silicon rubber raw materials, and although its molecular weight is not particularly limited, its average molecular weight is preferably not less than 10 thousand and not more than 1 million, and more preferably not less than 50 thousand and not more than 700 thousand.

The alkenyl group of organopolysiloxane described above is the site which reacts with an active hydrogen of organohydrogenpolysiloxane to form a cross-linkage point, and the kind thereof is not particularly limited. However, because of a high reactivity with active hydrogen, the alkenyl group is preferably at least one of a vinyl group and an allyl group, and more preferably a vinyl group. Organohydrogenpolysiloxane serves as a cross-linking agent for an addition reaction in a hardening process and preferably has not less than two hydrogen atoms bonded to each terminal silicon atom in one molecule. In order to cause a hardening reaction to take place in an optimal manner, a polymer having not less than three such atoms is more preferable.

The average molecular weight of organohydrogenpolysiloxane described above is not particularly limited, and is preferably about 1000 to 10000. In order to cause a hardening reaction to appropriately take place, a polymer with a relatively low molecular weight, of which average molecular weight is not less than 1000 and not more than 5000, is more preferable.

The above-described liquid silicone rubber may contain, for example, chloroplatinic hexahydrate as cross-linking catalyst for the above-described organohydrogenpolysiloxane. Moreover, as the cross-linking catalyst, a transition metal compound which exhibits a catalytic action in a hydrosilylation reaction may be used.

The above-described elastic layer material may be arbitrarily mixed with various additives such as non-conductive fillers and plasticizers so as to be within a range in which desired performance is obtained. Examples of non-conductive fillers include, for example, diatomaceous earth, quartz powder, dry silica, wet silica, aluminosilicate, and calcium carbonate, and the like. Examples of the plasticizer include, for example, polydimethylsiloxane oil, diphenylsilanediol, trimethylsilanol, phthalic acid derivative, adipic acid derivative, and the like. In general, conductive agents having an electron conduction mechanism, such as carbon black, graphite, and conductive metal oxides, and conductive agents having an ion conduction mechanism, such as alkali metal salts and quaternary ammonium salt are added to the elastic layer material as needed for adjustment to obtain a desired resistance.

The viscosity of the elastic layer material to be coated on the outer periphery of the shaft core body 101 by the circular coating head 38 is preferably 10 to 5000 Pa·s. The viscosity is a value at a shear rate of 1 $s^{-1}$ at 25° C. (in the same manner hereafter). Setting the viscosity of the elastic layer material to be not less than 10 Pa·s can inhibit sags of the elastic layer material in the gravity direction due to its own weight, thereby allowing the improvement in the precision of the outer diameter dimension and the deflection. Moreover, setting the viscosity of the elastic layer material to be not more than 5000 Pa·s can avoid the difficulty in stable material supply, which may be caused by a high load which is imposed on the apparatus because of a high viscosity of the elastic layer material at a shear rate within the piping for feeding the elastic layer material.

The layer thickness of the elastic layer material (elastic layer) is usually preferably in a range of 0.5 mm to 10.0 mm. More preferably, the range is 2.0 mm to 6.0 mm.

The level of the deflection (thickness variation of the elastic layer) at which an electrophotographic elastic roller can be suitably used is, though depends on the grade and durability of an electrophotographic recording apparatus, preferably not more than 60 μm, more preferably not more than 30 μm, and further preferably not more than 20 μm. Setting the deflection to be not more than 20 μm can inhibit the occurrence of imbalance in the stress which acts on other members, can prevent the acceleration of the attrition and degradation of a portion of high stress, and can prevent the occurrence of image deficiencies caused by an imbalance based on feed rate of electric charges and developing agents, particularly density variations.

The layer of the non-hardened elastic layer material which is coated on the outer periphery of the shaft core body 101 is heat treated by an infrared heating to be hardened to provide an electrophotographic elastic roller. The surface of the layer of non-hardened elastic layer material has adhesiveness. Therefore, the method of heat treatment is preferably an infrared heating which operates in a non-contact manner, of which apparatus is convenient, and which can perform uniform heat treatment in the longitudinal direction of the layer of the elastic layer material on the outer periphery of the shaft core body 101. In this occasion, fixing the infrared heating apparatus and circumferentially rotating the shaft core body 101 which is provided with a non-hardened material layer having a cylindrical shape (roll shape) enable a circumferentially uniform heat treatment. The heat treatment temperature of the surface of the elastic layer material is, though depends on the elastic layer material to be used, in the case of for example addition reaction cross-linked type liquid silicone rubber, preferably not less than 100° C., at which hardening reaction of the silicone rubber starts, and not more than 250° C.

Here, for the purpose of stabilizing the physical properties of the elastic layer after hardening, and removing the reaction residues and unreacted low-molecular components in the elastic layer, a secondary hardening such as heat treatment may be further performed on the elastic layer after the infrared heating. It is also preferable to thereafter cut off both ends of the elastic layer to form the elastic layer into a desired length, and to remove the starting end and terminal end of the elastic layer material in advance when it is formed on the shaft core body 101. As so far described, an electrophotographic elastic roller which utilizes the method relating to the present invention is manufactured.

(Developing Roller, Process Cartridge, Image Forming Apparatus)

An electrophotographic elastic roller manufactured by the manufacturing method relating to the present invention has a good dimensional precision, particularly a deflection precision (thickness precision of the elastic layer) and is of low cost. The elastic roller relating to the present invention can be used for developing rollers, charging rollers, transfer rollers, etc. since the elastic layer of the elastic roller has a good uniformity. Further, the process cartridge and the image forming apparatus relating to the present invention are provided with the electrophotographic elastic roller relating to the present invention as a developing roller, a charging roller, and a transfer roller, etc. Hereafter, an example which is provided with the electrophotographic elastic roller relating to the present invention as a developing roller will be shown.

The electrophotographic elastic roller relating to the present invention can be used as a developing roller. The developing roller carries a developing agent (toner), in a state of being opposed to and in contact or pressure contact with a photosensitive drum as a latent image bearing member that bears a latent image. The developing roller has a function of visualizing a latent image as a toner image by applying the toner as the developing agent to the photosensitive drum. The process cartridge and the image forming apparatus relating to the present invention use the electrophotographic elastic roller relating to the present invention as a developing roller. An example of the process cartridge and image forming apparatus which are provided with the electrophotographic elastic roller relating to the present invention as a developing roller is shown in FIG. 7.

Figure 7:
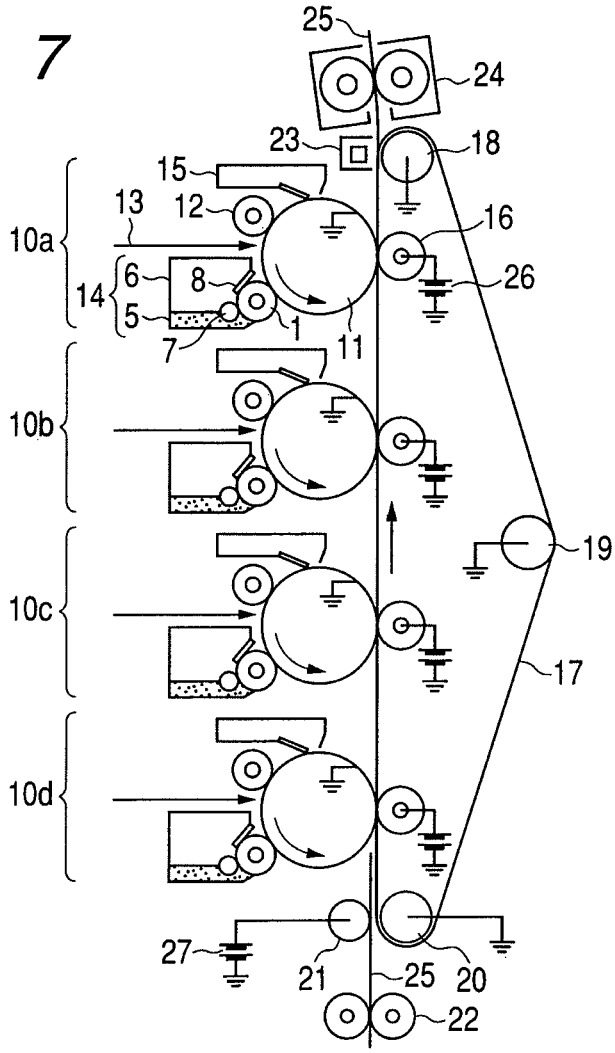
FIG. 7 is a schematic diagram to illustrate an example of an image forming apparatus provided with an elastic roller relating to the present invention.

The image forming apparatus shown in FIG. 7 is provided in a tandem manner with four image forming units 10*a* to 10*d* which form images of yellow, cyan, magenta and black, respectively. Each image, forming unit includes a photosensitive drum 11, a charging apparatus 12 (a charging roller in FIG. 7), an image exposure apparatus (a writing beam 13 in FIG. 7), a developing apparatus 14, a cleaning apparatus 15, an image transfer apparatus 16 (a transfer roller in FIG. 7), and others. The four image forming units 10*a* to 10*d* have the same basic configuration although there are slight differences in the adjustment of the specifications thereof depending on each color toner property. Moreover, the photosensitive drum 11, the charging apparatus 12, the developing apparatus 14 and the cleaning apparatus 15 are integrated to form a process cartridge.

The developing apparatus 14 is provided with a developer container 6 containing a non-magnetic one-component toner 5, and a developing roller 1, which is located at an opening part extending in the longitudinal direction within the developer container 6 and is placed opposed to the photosensitive drum 11. The developing apparatus 14 is configured to develop and visualize an electrostatic latent image on the photosensitive drum 11. Further, a toner feed roller 7 is provided which feeds the one-component toner 5 to the developing roller 1 and scrapes off the one-component toner 5 that is carried by the developing roller 1 without being used for development, from the developing roller 1. Moreover, a developer blade 8 is provided which regulates the carrying amount of the one-component toner 5 on the developing roller 1 and triboelectrical charges.

The surface of the photosensitive drum 11 is charged uniformly into a predetermined polarity and a predetermined potential by the charging apparatus 12. Then, image information is radiated as a beam 13 from an enhancing exposure apparatus to the surface of the charged photosensitive drum 11 thereby forming an electrostatic latent image. Next, the one-component toner 5 is fed onto the formed electrostatic latent image from the developing apparatus 14, which utilizes an elastic roller manufactured by the method relating to the present invention as the developing roller 1, thus forming a toner image on the surface of the photosensitive drum 11. When this toner image comes to a location opposed to the image transfer apparatus 16 as the photosensitive drum 11 rotates, the toner image is transferred to a transfer material 25 such as paper which is to be fed in synchronous with the rotation.

It is noted that in FIG. 7, the four image forming units 10*a* to 10*d* are interlockingly operated in series to form predetermined color images superposed onto one transfer material 25. Therefore, the transfer material 25 is synchronized with the image formation of each image forming unit, that is, the image formation is in synchronous with the insertion of the transfer material 25. For that purpose, a transfer conveyor belt 17 for conveying the transfer material 25 is engaged with a drive roller 18, a tension roller 19, and a follower roller 20 provided with the transfer conveyor belt 17 so as to be sandwiched between the photosensitive drum 11 and the image transfer apparatus 16. The transfer material 25 is conveyed in a form of being electrostatically adsorbed to the transfer conveyor belt 17 by the action of an adsorption roller 21. It is noted that a feed roller for feeding the transfer material 25 is denoted by 22.

The transfer material 25 on which an image has been formed is separated from the transfer conveyor belt 17 by the action of a separator apparatus 23 and is forwarded to a fixing apparatus 24 so that the toner image is fixed to the transfer material 25 thus completing a photographic printing. On the other hand, the photosensitive drum 11, which has finished the transfer of a toner image to the transfer material 25, further rotates so that the surface thereof is cleaned by the cleaning apparatus 15 and is neutralized by an neutralization apparatus (not shown) as needed. Thereafter, the photosensitive drum 11 is subjected to a next image formation. It is noted that in FIG. 7, bias power supplies to the image transfer apparatus 16 and the adsorption roller 21 are designated by 26 and 27, respectively.

So far, an apparatus of a tandem type in which a toner image of each color is transferred directly to a transfer material has been described, but this is not limiting. Other apparatuses, to which the elastic roller manufactured by the method relating to the present invention can be applied as a developing roller, include a black-and-white monochrome image forming apparatus and an image forming apparatus which temporarily forms a color image by superposing toner images of each color on the transfer roller or the transfer belt and transfers it onto a transfer member by one operation. Moreover, one can mention image forming apparatuses in which developing units of each color are disposed on a rotor or in parallel with a photosensitive drum, and the like. Furthermore, photosensitive drum, a charging apparatus, a developing apparatus, and so on may be directly incorporated in an image forming apparatus instead of a process cartridge.

EXAMPLES

Hereafter, the present invention will be described further detail in EXAMPLES, but these will not limit the present invention.

(Deflection: Thickness Variations Measurement of Elastic Layer)

Deflection was determined as the difference between a maximum value and a minimum value of the radius of the elastic roller. The radius of the elastic roller was measured, while the elastic roller was rotated with the shaft core body as the rotational axis, by a non-contact laser length-measuring instrument (LS-5000, KEYENCE CORPORATION) disposed vertically with respect to the rotational axis. The difference between a maximum value and a minimum value of the radius was measured in each pitch of 1 cm in the axial direction of the elastic layer, and the maximum value among the difference values was used as the value of thickness variation (deflection) of the elastic layer.

(Viscosity Measurement of Elastic Layer Material)

Viscosity measurement (RheoStress 600, Haake Co., Ltd.) was performed. About one gram of the elastic layer material was obtained (in a non-hardened state in which a liquid A and a liquid B are mixed with a mass ratio of 1:1 in the case of a silicone rubber material). This was placed on a plate and a cone was brought gradually closer thereto and a measurement gap was set at a position about 50 μm from the plate (the cone with a diameter of 35 mm and a slope of 1° was used). At that time, the elastic layer material which was pushed out to the periphery was clearly removed so as not to affect the measurement. The temperature of the plate was set such that the specimen temperature becomes 25° C. and measurement was started 10 minutes after specimen was placed. The shear rate applied to the specimen was varied starting from 0.1 $s^{-1}$ up to 10 $s^{-1}$ with a step of 0.2 $s^{-1}$, and the value of viscosity is determined by dividing a shear stress at a shear rate of 1 $s^{-1}$ by a shear rate 1 $s^{-1}$.

Example 1

As a coating apparatus for coating an elastic layer material to a shaft core body 101, an upright ring coating machine including a circular coating head 38 of the form shown in FIG. 1 was used.

(Preparation of Elastic Layer Material)

10 parts by mass of carbon black (MA11, Mitsubishi Chemical Corporation) was added to 100 parts by mass of each of a liquid A of an addition reaction cross-linked type liquid silicone rubber (DY35-1265A, Dow Corning Toray Co., Ltd.) and a liquid B of an addition reaction cross-linked type liquid silicone rubber (DY35-1265B, Dow Corning Toray Co., Ltd.), respectively. These are mixed and deformed for 30 minutes by a planetary mixer. Thereafter, the liquid A and the liquid B mixed with carbon black were respectively set in a material tank associated with the coating apparatus and were forwarded to a static mixer by using a pressure pump to mix the liquid A and the liquid B with a mass ratio of 1:1. This liquid silicone rubber mixture was used as the elastic layer material. Its viscosity was 600 Pa·s.

(Preliminary Preparation of Fabrication of Elastic Roller)

Upon manufacturing an elastic roller, as shown in FIG. 2, the position of the circular coating head 38 was adjusted such that the axial center of the upper shaft core body-holding shaft 40 coincides with the center of the circular coating head 38.

First, the position of the upper shaft core body-holding shaft 40 was measured with an optical length-measuring instrument 48 (LS-7000, KEYENCE CORPORATION, and not shown in FIG. 2) to calculate the central coordinate of the upper shaft core body-holding shaft 40. Next, the LM guide 34 (not shown in FIG. 2) was moved in a vertical direction such that the upper shaft core body-holding shaft 40 can be brought into contact with an ejection port which opens at the inward side of the circular coating head 38. Thereafter, the circular coating head 38 was moved in the X and Y directions (horizontal directions) by the circular coating head position correction X-Y stage 46 (not shown in FIG. 2), respectively. The circular coating head position correction X-Y stage 46 was driven by a stepping motor with a movement accuracy of 1 μm. A circuit was constructed so as to be brought into conduction when the circular coating head 38 comes into contact with the upper shaft core body-holding shaft 40, and the moving amount, with which the stepping motor was instructed when the circular coating head 38 comes into contact (conduction) with the upper shaft core body-holding shaft 40, was recorded in the X and Y directions. Based on the moving amount in the X and Y directions of the circular coating head 38, the central position of the circular coating head 38 with reference to the upper shaft core body-holding shaft 40 was calculated, and the circular coating head 38 was moved to the central position. To be specific, the circular coating head 38 was moved to a position which is supposed to be the middle of respective moving distances in the X and Y directions indicated by arrows in FIG. 2.

(Fabrication of Elastic Roller)

As shown in FIG. 3A, the upper end of a lower shaft core body-holding shaft 39 was disposed above (upward in vertical direction) the circular coating head 38 through a circular coating head 38. In this state, a shaft core body 101 comprised of iron having a length of 280 mm and an outer diameter of 6 mm and being set at the lower shaft core body-holding shaft 39 was gripped in a substantially vertical direction by moving down the upper shaft core body-holding shaft 40. Thereafter, as shown in FIG. 3B, the shaft core body 101 gripped by the LM guide 34 was moved down. At this moment, the coordinates (X and Y coordinates) of the shaft core body 101 were detected at three portions: an axial direction distance of 40 mm (longitudinal position 101-1) from an end (lower end) of the shaft core body 101; 140 mm which is the middle portion in the longitudinal direction of the shaft core body 101 (longitudinal position 101-2); and 240 mm (longitudinal position 101-3) from that, by an X-direction optical length-measuring instrument 48-1 and a Y-direction optical length-measuring instrument 48-2. The coordinate of the shaft core body 101 at the longitudinal position 101-2 were supposed to be the maximum deflection coordinate of the shaft core body 101 which was gripped and fixed. Thereafter, as shown in FIG. 3D, the lower shaft core body-holding shaft 39 was moved by the shaft core body position correction X-Y stage 47 so as to cancel the difference between the position coordinate of the shaft core body 101 at the longitudinal position 101-1 and the position coordinate of the shaft core body 101 at the longitudinal position 101-3. As a result of this, the two coordinates were made the same coordinate. Thus, the inclination of the both end parts of the shaft core body 101 due to the grip fix of the shaft core body 101 was corrected. Moreover, the difference between the central coordinate of the shaft core body 101 at the longitudinal position 101-1 after correction and the central coordinate of the upper shaft core body-holding shaft 40 which had been determined in advance was corrected by causing the circular coating head 38 to be moved by the circular coating head position correction X-Y stage 46. The x and Y coordinates after correction was set to the base point coordinate before the start of coating.

Thereafter, while the shaft core body 101 was being moved by causing the lower shaft core body-holding shaft 39 and the upper shaft core body-holding shaft 40 to move up (30 mm/sec) vertically from the base point coordinate, the elastic layer material was ejected at 2.52 ml/sec from the circular slit that opened at the inward side of the circular coating head 38. At this moment, for the time until the circular slit portion of the circular coating head 38 reached the position 101-2, the position of the circular coating head 38 was corrected (moved) by 25% of the maximum moving amount in the direction to the maximum deflection coordinate. It is noted that the correction of the circular coating head 38 was performed by the circular coating head position correction X-Y stage 46 to which the circular coating head 38 was fixed. After the circular slit portion of the circular coating head 38 reached the position 101-2, successively, the position of the circular coating head 38 was corrected (moved) in the direction to the base point coordinate and was returned to the base point coordinate when it reached the position 101-3. As a result of this, a layer of silicone rubber material was formed into a cylindrical shape (roll shape) on the outer periphery of the shaft core body 101. The shaft core body 101 was detached from the ring coating machine to fabricate a roller including a non-hardened shaped material layer (hereafter, referred to as non-hardened roller).

The non-hardened roller was rotated at 60 rpm with the shaft core body 101 as the center, and an infrared ray (output power of 1000 W) was radiated for 4 minutes to the surface of the non-hardened shaped material layer with an infrared heating lamp "HYL25" (trade name, manufactured by HYBEC CORPORATION) to harden the shaped material layer. It is noted that the distance between the non-hardened shape material layer surface and the lamp at the time of infrared irradiation was 60 mm, and the temperature of the surface of the non-hardened shape material layer was 200° C. Thereafter, for the purpose of stabilizing the physical properties of the elastic layer of hardened silicone rubber and removing the reaction residues and unreacted low-molecular components in the elastic layer of silicone rubber, secondary hardening was performed in an electric furnace at 200° C. for 4 hours. Thus, an elastic roller including a silicone layer (elastic layer 102) of a layer thickness of 3.0 mm on the outer periphery of the shaft core body 101 was obtained.

In this way, 1000 electrophotographic elastic rollers were fabricated in the same manner. The distribution of the deflections in the longitudinal direction (longitudinal position 101-2) of the gripped and fixed shaft core body 101 of the shaft core bodies 101 that were incorporated at that time, and the distribution of the deflections of 1000 elastic rollers that were fabricated are shown in Table 1. Among the electrophotographic elastic rollers fabricated in the present example, 100% of them showed a deflection of less than 30 μm meaning that electrophotographic elastic rollers with small deflections were able to be produced in a stable manner with a good reproducibility.

Example 2

Electrophotographic elastic rollers were fabricated in the same manner as in Example 1 except that for the time until the circular slit portion of the circular coating head 38 reached the position 101-2, the position of the circular coating head 38 was corrected (moved) by 5% of the maximum moving amount to the direction of the maximum deflection coordinate.

Thus, 1000 electrophotographic elastic rollers were fabricated in the same manner. The distribution of the deflections in the longitudinal direction (longitudinal position 101-2) of the gripped and fixed shaft core body 101 of the shaft core bodies 101 that were incorporated at that time, and the distribution of the deflections of 1000 elastic rollers that were fabricated are shown in Table 1. Among the electrophotographic elastic rollers fabricated in the present example, 100% of them showed a deflection of less than 30 μm meaning that electrophotographic elastic rollers with small deflections were able to be produced in a stable manner with a good reproducibility.

Example 3

Electrophotographic elastic rollers were fabricated in the same manner as in Example 1 except that for the time until the circular slit portion of the circular coating head 38 reached the position 101-2, the position of the circular coating head 38 was corrected (moved) by 50% of the maximum moving amount to the direction of the maximum deflection coordinate.

Thus, 1000 electrophotographic elastic rollers were fabricated in the same manner. The distribution of the deflections in the longitudinal direction (longitudinal position 101-2) of the gripped and fixed shaft core body 101 of the shaft core bodies 101 that were incorporated at that time, and the distribution of the deflections of 1000 elastic rollers that were fabricated are shown in Table 1. Among the electrophotographic elastic rollers fabricated in the present example, 100% of them showed a deflection of less than 30 μm meaning that electrophotographic elastic rollers with small deflections were able to be produced in a stable manner with a good reproducibility.

Example 4

Electrophotographic elastic rollers were fabricated in the same manner as in Example 1 except that for the time until the circular slit portion of the circular coating head 38 reached the position 101-2, the position of the circular coating head 38 was corrected (moved) by 1% of the maximum moving amount to the direction of the maximum deflection coordinate.

Thus, 1000 electrophotographic elastic rollers were fabricated in the same manner. The distribution of the deflections in the longitudinal direction (longitudinal position 101-2) of the gripped and fixed shaft core body 101 of the shaft core bodies 101 that were incorporated at that time, and the distribution of the deflections of 1000 elastic rollers that were fabricated are shown in Table 1. Among the electrophotographic elastic rollers fabricated in the present example, 100% of them showed a deflection of less than 30 μm meaning that electrophotographic elastic rollers with small deflections were able to be produced in a stable manner with a good reproducibility.

Example 5

Electrophotographic elastic rollers were fabricated in the same manner as in Example 1 except that for the time until the circular slit portion of the circular coating head 38 reached the position 101-2, the position of the circular coating head 38 was corrected (moved) by 80% of the maximum moving amount to the direction of the maximum deflection coordinate.

Thus, 1000 electrophotographic elastic rollers were fabricated in the same manner. The distribution of the deflections in the longitudinal direction (longitudinal position 101-2) of the gripped and fixed shaft core body 101 of the shaft core bodies 101 that were incorporated at that time, and the distribution of the deflections of 1000 elastic rollers that were fabricated are shown in Table 1. Among the electrophotographic elastic rollers fabricated in the present example, 100% of them showed a deflection of less than 30 μm meaning that electrophotographic elastic rollers with small deflections were able to be produced in a stable manner with a good reproducibility.

Comparative Example 1

Electrophotographic elastic rollers were fabricated in the same manner as in Example 1 except that circular coating head position correction was not performed during the ejection coating of the elastic layer material.

Thus, 1000 electrophotographic elastic rollers were fabricated in the same manner. The distribution of the deflections in the longitudinal direction (longitudinal position 101-2) of the gripped and fixed shaft core body 101 of the shaft core bodies 101 that were gripped and fixated at that time, and the distribution of the deflections of 1000 elastic rollers that were fabricated are shown in Table 1. Among the electrophotographic elastic rollers fabricated in the present comparative example, 57% of them showed a deflection of less than 30 μm, and 83% of them showed a deflection of less than 60 μm. Thus, in the method of the present comparative example, electrophotographic elastic rollers with small deflections were unable to be manufactured in a stable manner.

TABLE 1

| | Example 1 | | Comparative example 1 | |
|---|---|---|---|---|
| Deflection (μm) | Distribution of deflection in longitudinal direction of shaft core body (number of shaft core bodies) | Distribution of deflection of electrophotographic elastic rollers (number of rollers) | Distribution of deflection in longitudinal direction of shaft core body (number of shaft core bodies) | Distribution of deflection of electrophotographic elastic rollers (number of rollers) |
| 0 ≤ and < 20 | 200 | 868 | 200 | 256 |
| 20 ≤ and < 30 | 300 | 132 | 300 | 314 |
| 30 ≤ and < 60 | 300 | 0 | 300 | 258 |
| 60 ≤ and < 100 | 200 | 0 | 200 | 172 |

| | Example 2 | |
|---|---|---|
| Deflection (μm) | Distribution of deflection in longitudinal direction of shaft core body (number of shaft core bodies) | Distribution of deflection of electrophotographic elastic rollers (number of rollers) |
| 0 ≤ and < 20 | 200 | 855 |
| 20 ≤ and < 30 | 300 | 145 |
| 30 ≤ and < 60 | 300 | 0 |
| 60 ≤ and < 100 | 200 | 0 |

| | Example 3 | |
|---|---|---|
| Deflection (μm) | Distribution of deflection in longitudinal direction of shaft core body (number of shaft core bodies) | Distribution of deflection of electrophotographic elastic rollers (number of rollers) |
| 0 ≤ and < 20 | 200 | 846 |
| 20 ≤ and < 30 | 300 | 154 |
| 30 ≤ and < 60 | 300 | 0 |

TABLE 1-continued

| | | |
|---|---|---|
| 60 ≤ and < 100 | 200 | 0 |

| | Example 4 | |
|---|---|---|
| Deflection (μm) | Distribution of deflection in longitudinal direction of shaft core body (number of shaft core bodies) | Distribution of deflection of electrophotographic elastic rollers (number of rollers) |
| 0 ≤ and < 20 | 200 | 503 |
| 20 ≤ and < 30 | 300 | 497 |
| 30 ≤ and < 60 | 300 | 0 |
| 60 ≤ and < 100 | 200 | 0 |

| | Example 5 | |
|---|---|---|
| Deflection (μm) | Distribution of deflection in longitudinal direction of shaft core body (number of shaft core bodies) | Distribution of deflection of electrophotographic elastic rollers (number of rollers) |
| 0 ≤ and < 20 | 200 | 786 |
| 20 ≤ and < 30 | 300 | 214 |
| 30 ≤ and < 60 | 300 | 0 |
| 60 ≤ and < 100 | 200 | 0 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-159486, filed on Jul. 6, 2009, which is hereby incorporated by reference herein in its entirety.

What is claimed is:

1. A method for manufacturing an electrophotographic elastic roller, in which end parts of a shaft core body are gripped and fixed in a vertical direction, an inclination of a central axis connecting centers of end faces of the shaft core body with respect to the vertical direction due to the grip and fix of the shaft core body is corrected, a circular coating head including a circular slit that opens inwardly is used so that the shaft core body is relatively moved in the vertical direction with respect to the circular coating head, and a non-hardened elastic layer material is ejected from the circular slit to be coated and hardened on an outer periphery of the shaft core body, the method for manufacturing the electrophotographic elastic roller comprising:

a shaft core body deflection coordinates detection step in which maximum deflection coordinates in a longitudinal direction of the shaft core body which is gripped and fixed are detected at a middle position in the longitudinal direction of the shaft core body, with a central axis of the shaft core body taken as base point coordinates before the ejection to coat the non-hardened elastic layer material; and a circular coating head position correction step in which a central position of the circular coating head is moved at a constant proportion from the base point coordinates in the direction to the maximum deflection coordinates during the ejection to coat the non-hardened elastic layer material, the central position of the circular coating head is moved at a constant proportion in the direction to the base point coordinates after the circular coating head has reached the middle position in the longitudinal direction of the shaft core body at which the maximum deflection coordinates have been detected, and a moving amount of the circular coating head at the middle position in the longitudinal direction is 1% or more and 80% or less of the maximum deflection coordinates.

2. The method for manufacturing the electrophotographic elastic roller according to claim 1, wherein the circular coating head position correction step is performed by an X-Y stage moving the circular coating head, the circular coating head being fixed to the X-Y stage.

3. The method for manufacturing the electrophotographic elastic roller according to claim 1, wherein the shaft core body deflection coordinates detection step and the circular coating head position correction step are repeated.

4. The method for manufacturing the electrophotographic elastic roller according to claim 1, wherein a viscosity of the non-hardened elastic layer material is 10 Pa·s or more and 5000 Pa·s or less.

5. The method of manufacturing the electrophotographic elastic roller according to claim 1, wherein a maximum moving amount of the circular coating head is from the base point coordinates to 5% or more and 50% or less of the maximum deflection coordinates.

* * * * *